United States Patent [19]

Probst

[11] 4,067,293

[45] Jan. 10, 1978

[54] PLANT FOR SURFACE TREATING, IN PARTICULAR PICKLING AND PHOSPHATIZING, METALLIC WORK PIECES

[75] Inventor: Walter Probst, Vienna-Mauer, Austria

[73] Assignee: Vereinigte Osterreichische Eisen- und Stahlwerke - Alpine Montan Aktiengesellschaft, Linz, Austria

[21] Appl. No.: 703,129

[22] Filed: July 7, 1976

[30] Foreign Application Priority Data

July 11, 1975 Austria ..... 5362/75

[51] Int. Cl.[2] ..... B05C 5/00; B05C 15/00

[52] U.S. Cl. ..... 118/73; 118/114; 118/314; 118/316; 118/326; 134/82

[58] Field of Search ..... 15/77; 134/82, 83, 165, 134/199; 118/326, 314, 316, 73, 114, DIG. 7

[56] References Cited

U.S. PATENT DOCUMENTS

| | | | |
|---|---|---|---|
| 1,964,790 | 7/1934 | Roberts | 118/326 X |
| 2,721,564 | 10/1955 | Kearney | 134/82 X |
| 2,919,639 | 1/1960 | Cronin | 118/314 X |
| 3,245,102 | 4/1966 | Gallmeyer et al. | 15/77 |
| 3,830,196 | 8/1974 | Guttman et al. | 118/326 X |

*Primary Examiner*—John P. McIntosh
*Attorney, Agent, or Firm*—Burns, Doane, Swecker & Mathis

[57] ABSTRACT

A plant for the continuous surface treatment of work pieces comprises a plurality of treatment chambers arranged one behind the other and tightly connected to one another; each treatment chamber is movable transversely to the direction of transportation of the work pieces and at least part of the internal equipment provided in the treatment chambers is removable in longitudinal direction, i.e. parallel relative to the direction of transportation of the work pieces.

12 Claims, 10 Drawing Figures

Figure 1:
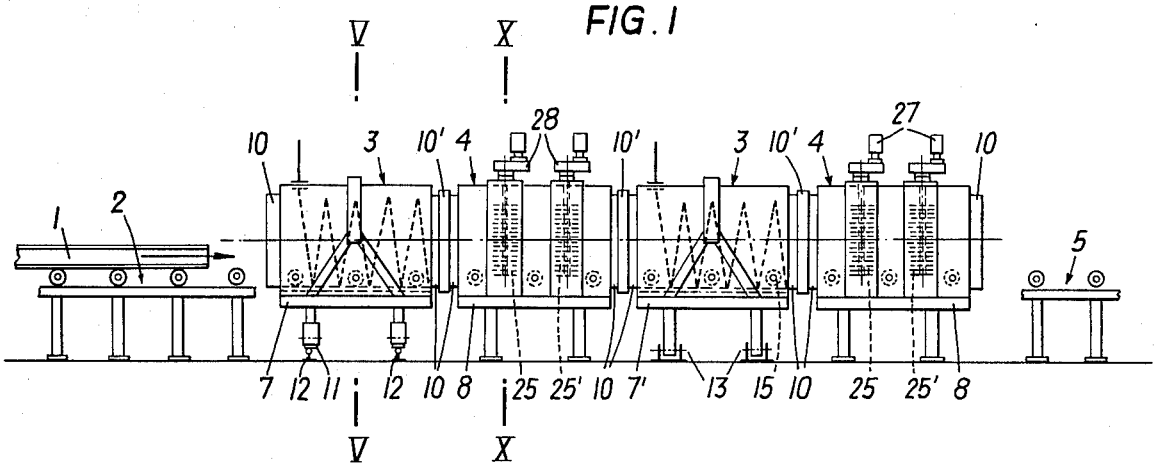

PLANT FOR SURFACE TREATING, IN PARTICULAR PICKLING AND PHOSPHATIZING, METALLIC WORK PIECES

The invention relates to a plant for the continuous surface treatment of metallic work pieces, in particular for the pickling or phosphatizing of beam, angle and steel bar sections and sheet or plate, respectively, having a plurality of treatment chambers arranged one behind the other and tightly connected to one another, in which, as desired, spraying nozzles, jet units, brushing elements and the like are provided, and conveying rollers are arranged for transporting the metallic work pieces within the treatment chambers.

In such plants, spraying chambers are arranged one behind the other, and, if desired, intermediate brushing elements are provided, so that a treatment mill is created which can be continuously passed by the work pieces to be treated. Such treatment mills are installed for a certain throughput capacity. A re-construction for a change in the capacity, as it may be necessary for work pieces having different dimensions, causes high costs, so that such a re-construction generally cannot be carried out. A resetting of known treatment mills for carrying out other than the originally planned steps of treatment requires a lengthy interruption of operation and thus also causes high costs. Also, longer standstills will have to be put up with when the treatment chambers or their installations are repaired.

The invention aims at preventing the above described disadvantages and difficulties and has as its object to create a plant of the above defined kind, in which an exchange of the treatment chambers as well as an exchange of the installations provided in the treatment chambers are possible within the shortest possible time, so that the plant can be adapted to various throughputs with a minimum of costs and that repairs hardly any periods of standstill for the plant. Furthermore, it should be possible to raise the throughout speed and the throughput number of the work pieces by a simple addition of further treatment chambers. The plant as a whole is to form a light construction without heavy supporting elements and bases.

According to the present invention these objects are achieved in a plant of the above defined kind in that each treatment chamber is movable transversely to the transport direction of the work pieces and the installations of each treatment chamber are at least partly removable from the treatment chamber in longitudinal direction, i.e. parallel to the direction of transport.

Suitably, all the treatment chambers have the same longitudinal extensions and the same connecting pieces.

According to a preferred embodiment, the treatment chambers are displaceable on rollers transversely to the direction of transport or pivotable.

Treatment chambers intended for pickling or phosphatizing, respectively, advantageously have a frame-shaped inset, where-upon supporting brackets with conveying rollers and spraying-nozzle-containing tube coils are fastened for supplying the treating medium, wherein the inset slidably rests on a supporting construction in the treatment chamber. Thereby it is possible to run out all the installations of a treatment chamber in a single operation and to exchange them for other installations, e.g. for intact ones or differently dimensioned ones.

For an easy exchange of the brushing elements, those treatment chambers intended for brushing have a frame-shaped inset, in which the brushes are rotatably mounted, wherein the inset slidably rests on a supporting construction in the treatment chamber.

Advantageously, the supporting construction and the installations are made of synthetic material, in particular polypropylene.

Suitably, the tube coils are designed having two or more coils. By using these tube coils the capacity of a treatment chamber can easily be adpated to the respective required throughput capacity of the plant.

It is advantageous to make the treatment chambers of synthetic material and to install them in and support them by a light steel construction.

A further preferred embodiment consists in that part of the treatment chambers is provided with driven conveying rollers, whose shafts penetrate the walls of the treatment chambers, wherein the other installations of the treatment chambers are detachable from the conveying rollers and removable from the treatment chambers in longitudinal direction.

Advantageously, the removable installations are suspended on consoles of the treatment chamber reaching into the interior thereof.

Figure 3:
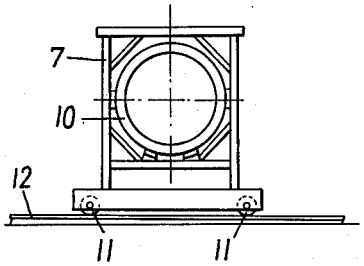
Figure 4:
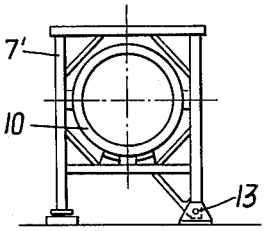
Figure 5:
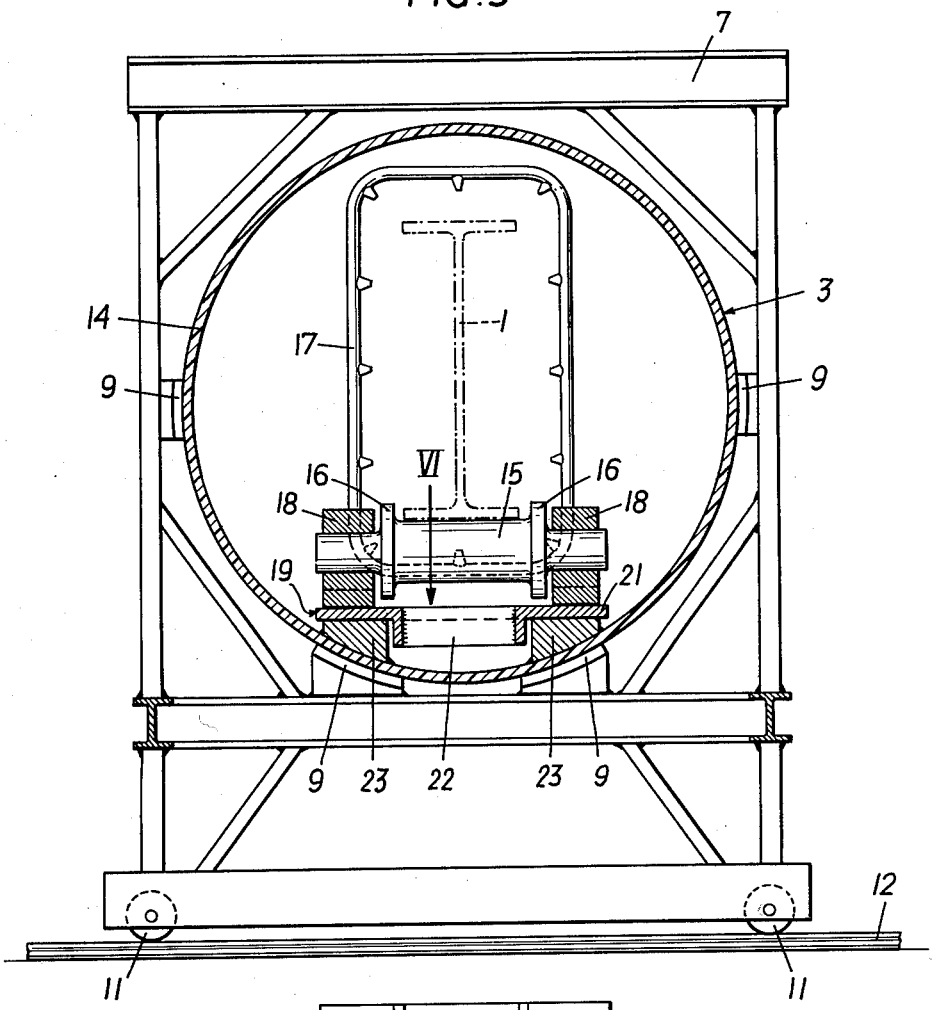
Figure 6:
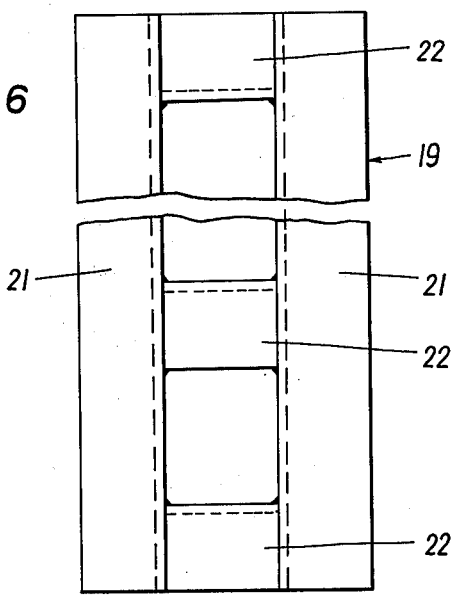
Figure 7:
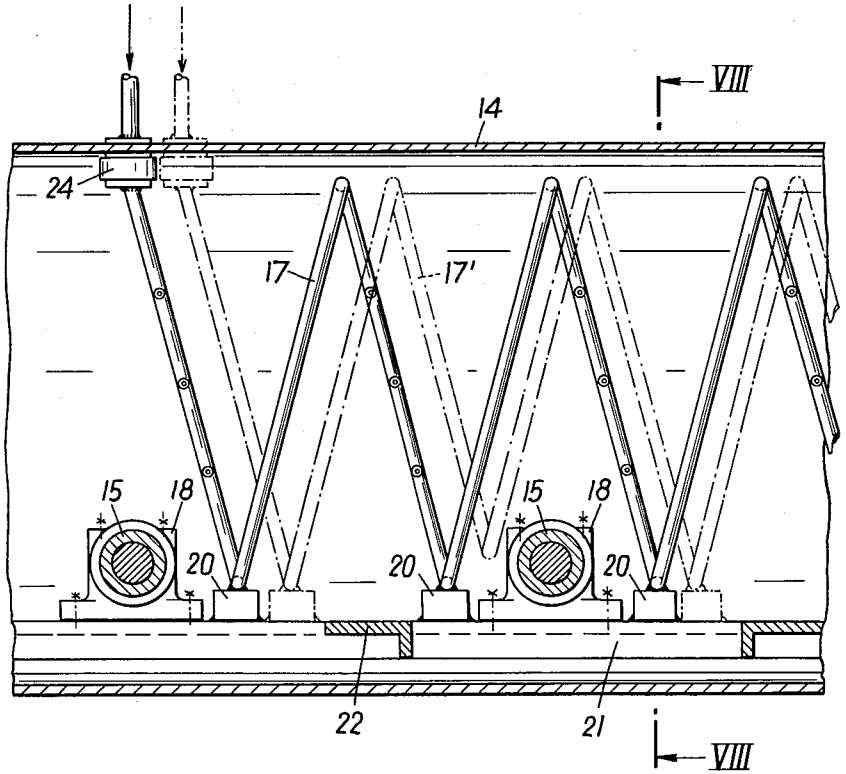
Figure 8:
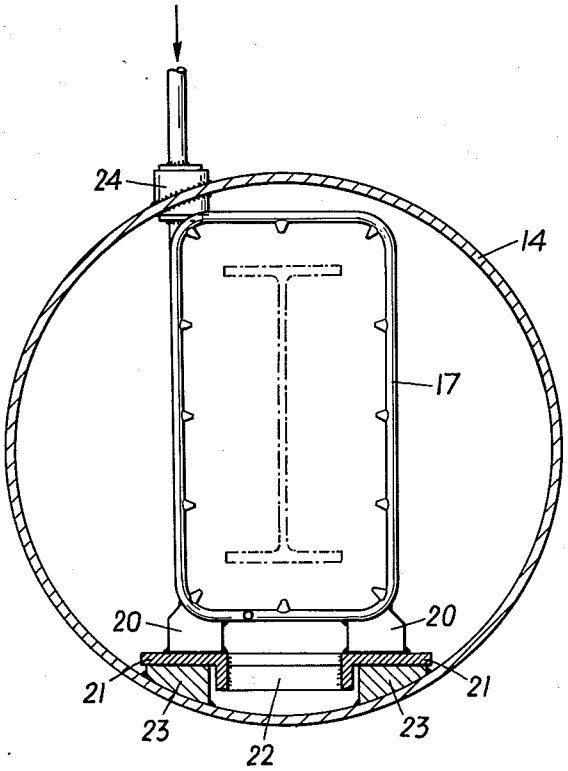
Figure 10:
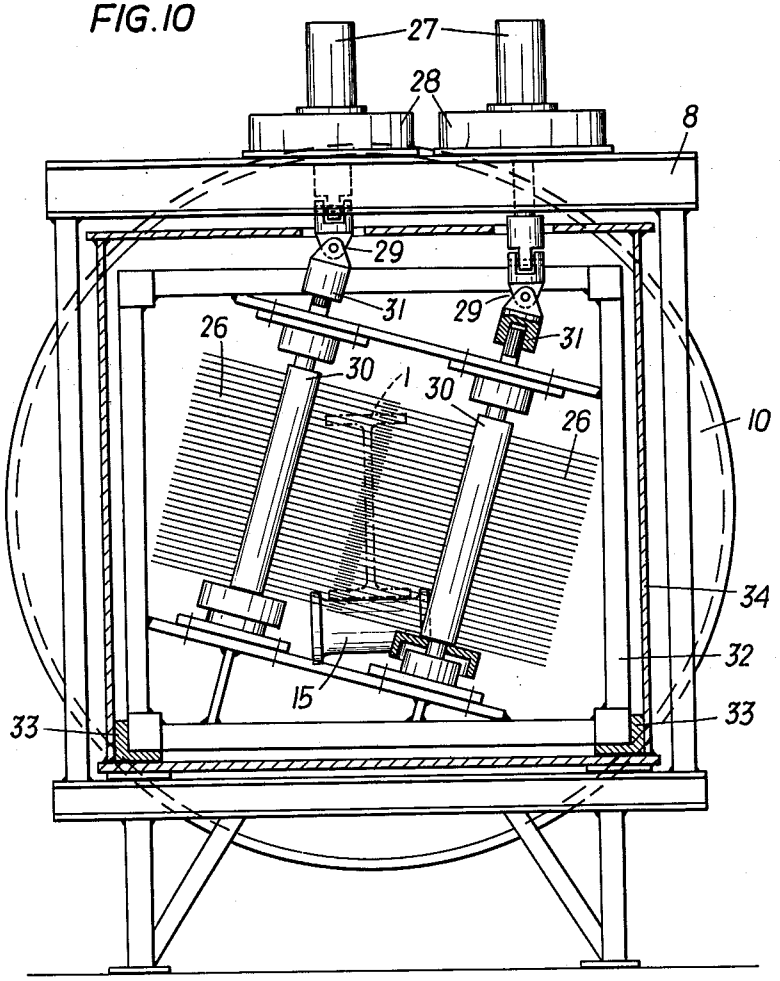
Figure 9:
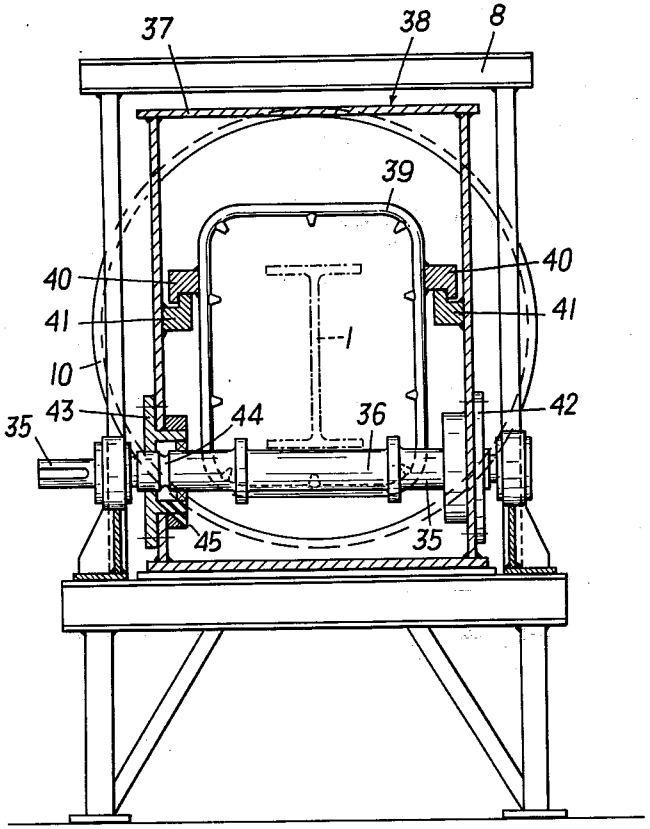

The invention shall now be explained in more detail by way of example only and with reference to the accompanying drawings, wherein:

FIG. 1 is a schematical illustration of the plant in front view,

FIG. is a ground plan,

FIGS. 3 and 4 show one view each of a treatment chamber in conveying direction of the work pieces, also as schematical illustrations, FIG. 5 is the view of a section along line V—V of FIG. 1 through a treatment chamber intended for pickling or phosphatizing, respectively, FIG. 6 is a top view of the frame-shaped inset in the direction of the arrow VI of FIG. 5, FIG. 7 represents a longitudinal section, FIG. 8 illustrates a section along line VIII—VIII of FIG. 7 through a treatment chamber as shown in FIG. 5, FIG. 9 is a section analogous to FIG. 5 through a treatment chamber according to a different embodiment, and FIG. 10 is a section along line X—X of FIG. 1 through a treatment chamber equipped with brushing elements.

The work pieces 1 to be treated, e.g., I-beams, are moved in the direction of the arrow from the run-in roller table 2 through the spraying chambers 3 arranged one behind the other and intended for pickling or phosphatizing, respectively, and through intermediate brushing chambers 4, and subsequently they reach the run-out roller table 5. It is a characteristic of the plant according to the invention that all the treatment chambers 3 and 4 have the same lengths and the same connecting pieces 10, so that they are interchangeable. Preferably, the chambers also have the same widths.

Figure 2:
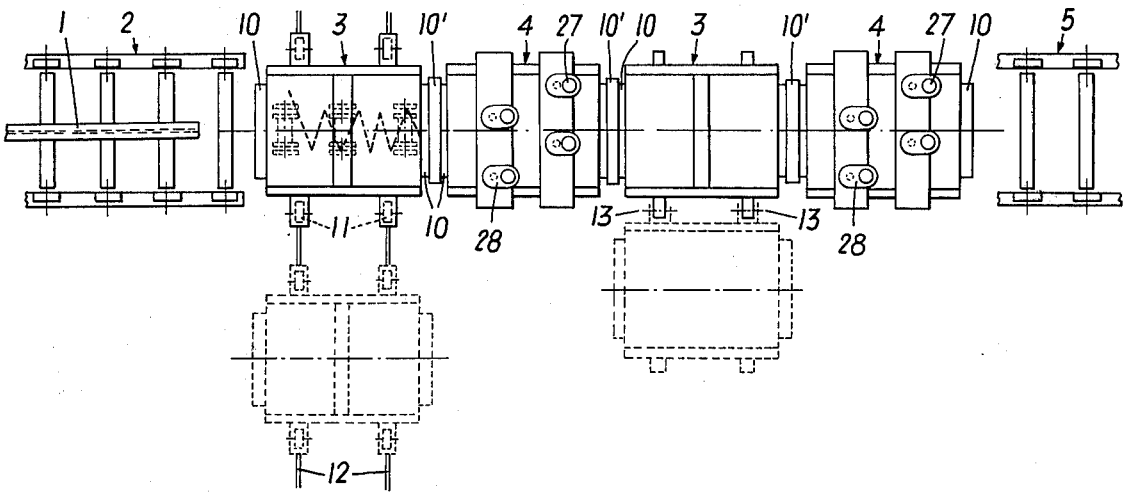

Each one of the treatment chambers is inserted into a light steel structure 7, 7' and 8 with intermediate bearings 9 of syntehtic material, which support the chambers. According to the invention the steel structures are designed in a manner that after opening the sealings 10' connecting the treatment chambers, which sealings are preferably designed as quick locks, the treatment chambers are movable transversely to the transport direction of the work pieces. For example, the steel structure 7 can be run out by means of wheels 11 on tracks 12. The steel structure 7' is pivotable around the bolts 13. The pivoted out or run out treatment chambers are shown in broken lines in FIG. 2. The treatment chambers can also be removed by means of a crane that is, e.g., necessary for the removal of the steel structure 8.

When the work piece 1 enters a spraying chamber 3 that is surrounded by a jacket 14 of synthetic material, it is guided by the rollers 15 arranged in the spraying chamber through a set of nozzles 17 consisting of a spirally wound tube coil having nozzles distributed over its length and sprayed from all sides. The rollers 15, which have lateral rims 16 for a better guiding of the work pieces, are arranged in supporting brackets 18 mounted on a frame-shaped inset 19. This frame-shaped inset 19 also carries the bearings 20, via which the nozzle set 17 is fastened on the inset 19. The frame-shaped inset 19 consists of two parallel longitudinal rails 21 that are connected by transverse bridges 22. With its longitudinal rails 21 it rests on slide paths 23 rigidly arranged in the jacket 14 of the spraying chambers 3 and can be axially extracted from the jacket along them together with the nozzle set 17 and the rollers 15 after detaching the supply conduit for the treating medium from the connection pieces 24. Thus it is possible to easily and quickly exchange the nozzle set 17 by exchanging the inset 19 depending on the size of the work pieces for another set of nozzles corresponding to the intended size of the work pieces. For increasing the capacity of the plant, an inset having two sets of nozzles 17 and 17' can be inserted into the treatment chamber, as can be seen in FIG. 7 in dot-and-dash line, e.g.. For a further intensification of the spraying treatment, further sets of nozzles may be mounted on the inset.

After passing the spraying chamber 3 the work piece reaches a treatment chamber designed for brushing and illustrated in more detail in FIG. 10, having two pairs of brushes 25 and 25' arranged one behind the other in the direction of conveyance. Through this chamber, too, the work piece is guided on rollers 15 having lateral rims. As can be seen from FIG. 10, the brushes 26 arranged in pairs mesh so far that a work piece guided through between the brushes, whose profile is entered in broken lines in FIG. 10, is brushed. The slanting arrangement of the brush shafts safeguards brushing of the horizontal faces of the work piece. The second pair of brushes 25' is inclined to the same degree as the pair 25, but in the opposite direction, so that also areas not brushed by the brushes of the first pair are brushed. Each one of the brushes 26 is driven by its own motor 27 via a gear 28 and cardan joints 29, the motor being arranged on the respective steel structure 8. Between the cardan joints 29 and the shafts 30 of the brushes, always one coupling 31 — detachable in axis direction — is arranged so that the drive motors 27, when detached from the steel structure, can be taken off the brush shafts together with the gears and the cardan joints. The brush shafts are rotatably mounted in a frame-shaped inset 32. The frame-shaped inset 32 can be withdrawn from the chamber on guide tracks 33 fastened on the jacket 34 of the chamber, whereby it is possible to obtain as short an exchange period of the brushes as possible. This inset 32 suitably also carries the rollers 15. By changing the positions of the motors 27 on the structure 8 and the bearings of the brush shafts 30 in the inset 32, the brushes can be set at various inclinations, so that also for section other than that depicted in FIG. 10 the most favorable position of the brushes can be adjusted.

The brushes are rotated in a direction that they move in the conveying direction of the work piece when getting into contact therewith, whereby they add to the advance of the work piece. Only the brushes arranged at the end of the plant before the run-out roller table rotate opposite to the conveying direction in order to achieve as good a brushing off of the treating medium as possible.

The work pieces can either be driven by driving the work pieces being on the run-in roller table, which push the work pieces in the treatment chambers onwards, or by driven rollers, as shown in FIG. 9, wherein in both cases the direction of conveying may be slightly downwardly inclined relative to the horizontal to help convey the work pieces. If driven rollers are used, the axes 35 and 35' of the conveying rollers 36 coated with synthetic material are guided to the outside through the jacket 37 of the treatment chamber 38, which jacket 37 suitably has a rectangular profile, and mounted outside the chamber. A drive can be connected to the extending axis 35'. In this embodiment of the treatment chamber according to the invention the set of nozzles 39 is connected by ledges 40 to form a stable unit and with these ledges it rests on consoles 41 arranged laterally of the chamber and protruding inwardly. When the set of nozzles 39 has been lifted above the conveying rollers 36, it can be removed from the chamber in longitudinal direction. The conveying rollers 36 can be taken out of the chamber in the direction of their axes after detaching of the sealing plates 42 and 43. Turned grooves 44 on the conveying roller axes prevent the treating medium from flowing out along the axes, wherein any small amounts possibly present can flow back via the flow back bores 45 into the interior of the chamber 38.

For obtaining an adjustment to the work pieces, in particular to their surface conditions, the amount of the treating medium, the number of revolutions of the brushes as well as the throughput speed of the work pieces through the plant can be varied. The relationship between these three components can be found easily by way of experiment so that whenever the throughput speed is altered, the plant can automatically be readjusted to a respective favorable amount of spraying agent and number of revolutions of the brushes.

What I claim is:

1. In a plant for surface treating, in particular pickling and phosphatizing metallic work pieces having a plurality of treatment chambers arranged one behind the other, tightly connected to one another and provided with internal equipment, such as working tools, supporting elements and conveying rollers for transportation of the work pieces within the treatment chambers, the improvement wherein there are at least three chambers, each chamber having releasable connecting means at both ends for releasable connection to adjoining chambers, said connecting means of all chambers being substantially identical and all chambers being of equal length so that all chambers are interchangeable with one another, and means for individual displacement of each of the treatment chambers transversely of the direction of transportation of the work pieces to enable at least part of the internal equipment of a chamber to be removed from the chamber in a longitudinal direction parallel to the direction of transportation of the work pieces, and to enable the chambers to be replaced or interchanged.

2. A plant as set forth in claim 1, wherein the working tools are selectively designed as spraying nozzle units, jet units and brushing elements.

3. A plant as set forth in claim 1, wherein said chambers comprise first treatment chambers equipped with spraying nozzles and second treatment chambers equipped with brushing elements.

4. A plant as set forth in claim 1, wherein the means for moving the treatment chambers transversely to the direction of transportation of the work pieces include rollers by which the treatment chambers are displaceable.

5. A plant as set forth in claim 1, wherein the means for moving the treatment chambers transversely to the direction of transportation of the work pieces comprises a pivotal mounting whose axis of rotation is parallel to the direction of transportation.

6. A plant as set forth in claim 1 for pickling or phosphatizing metallic work pieces, wherein the internal equipment of at least one of the treatment chambers comprises a supporting track construction arranged in a treatment chamber, a frame-shaped inset slidably supported on said supporting track construction, supporting brackets secured to the frame-shaped inset, conveying rollers supported in the supporting brackets, and a tube coil provided with spraying nozzles for supplying a treating medium and supported by the frame-shaped inset.

7. A plant as set forth in claim 6, wherein there are a plurality of said coils in said chamber, said coils each being of helical configuration and being longitudinally overlapping relative to one another.

8. A plant as set forth in claim 1, wherein the internal equipment of at least one of the treatment chambers comprises a supporting track construction arranged in the treatment chamber, a frame-shaped inset slidably supported on the supporting track construction, and brushes rotatably mounted on the frame-shaped inset.

9. A plant as set forth in claim 1, wherein part of the treatment chambers is provided with driven conveying rollers having shafts penetrating the treatment chambers and wherein the remaining internal equipment of the treatment chambers is detachable from the conveying rollers and removable from the treatment chambers in longitudinal direction.

10. A plant as set forth in claim 9, further comprising inwardly projecting consoles for suspending the removable internal equipment thereon.

11. A plant according to claim 1 including a plurality of support frames associated with respective ones of said chambers, each chamber being removably mounted on its associated support frame.

12. A plant according to claim 1, wherein each chamber includes internal longitudinally extending track means, and a frame longitudinally slidable along said track means and carrying at least a portion of the equipment associated with the respective chamber, so that said portion of equipment can be removed from, or inserted into, the chamber by sliding said frame along said track means.

* * * * *